US006317017B1

(12) United States Patent
Takenaka

(10) Patent No.: US 6,317,017 B1
(45) Date of Patent: Nov. 13, 2001

(54) RESONATOR HAVING A VARIABLE RESONANCE FREQUENCY

(75) Inventor: Tsutomu Takenaka, Tokorozawa (JP)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/425,325

(22) Filed: Oct. 21, 1999

(30) Foreign Application Priority Data

Oct. 30, 1998 (JP) ..... 10-310287

(51) Int. Cl.[7] ..... H01P 7/00; H01P 7/10
(52) U.S. Cl. ..... 333/235; 333/219.1
(58) Field of Search ..... 333/219, 219.1, 333/235; 331/96, 66

(56) References Cited

U.S. PATENT DOCUMENTS

| | | | | |
|---|---|---|---|---|
| 4,282,499 | * | 8/1981 | DeFonzo | 333/235 X |
| 4,484,162 | | 11/1984 | Kamada et al. | 333/219 |
| 4,639,690 | | 1/1987 | Lewis | 331/96 |
| 4,728,913 | | 3/1988 | Ishikawa et al. | 333/235 |
| 5,311,160 | | 5/1994 | Higuchi et al. | 333/219.1 |
| 5,373,262 | | 12/1994 | Yamamoto et al. | 331/96 |
| 5,555,019 | | 9/1996 | Dole | 348/148 |

FOREIGN PATENT DOCUMENTS

| | | |
|---|---|---|
| 62154803 | 7/1987 | (JP) . |
| 05315820 | 11/1993 | (JP) . |

OTHER PUBLICATIONS

P. R. Herczfeld et al., "Indirect Optical Injection Locking of Dielectric Resonator Oscillator for Phased Array Application" IEEE Symposium on Antennas ans Propagation, Jun. 17–21, 1985, pp. 35–39.

Nesic, Aleksandar; "A New Method for Frequency Modulation of Dielectric Resonator Oscillators", Proceedings of 15th European Microwave Conference, 1985, vol. 15, pp. 403–406.

Herczfeld, P.R. et al. "Optically Tuned and FM Modulated X–Band Dielectric Resonator Oscillator", 14th European Microwave Conference Liege, 1984, vol. 14, pp. 268–273.

* cited by examiner

*Primary Examiner*—Justin P. Bettendorf
*Assistant Examiner*—Stephen E. Jones

(57) ABSTRACT

A resonator having a variable resonance frequency. The resonator includes a cavity enclosed by a conducting wall. A resonating element and a conductive plate are located within the cavity. A photoconductive element is connected between two points on the conductive plate. The resonator also includes a light source for irradiating the photoconductive element with light of the predetermined wavelength. In the preferred embodiment, the conductive plate is circular and includes a gap, the photoconductive element connecting two points on the gap and the resonating element is a cylindrical dielectric resonator element having a $TE_{01\delta}$ mode electromagnetic field distribution. The circular conductive plate is preferably placed parallel to the top surface of the cylindrical dielectric resonator substantially midway between the top surface and the inner surface of the conducting wall. The diameter of the circular plate is preferably greater than that of the cylindrical dielectric resonator. In one embodiment of the present invention, the photoconductive element includes first and second photoconductive regions, the first photoconductive region connecting first and second points on the conductive plate and the second photoconductive region connecting third and fourth points on the conductive plate. In this embodiment, the light source includes first and second light emitting elements, for respectively illuminating said first and second photoconductive regions. The magnitude of the change in resonance frequency induced by illuminating the photoconductive region can be altered by adjusting the relative position of the photoconductive element and the light source.

9 Claims, 3 Drawing Sheets

RESONATOR HAVING A VARIABLE RESONANCE FREQUENCY

FIELD OF THE INVENTION

The present invention relates to high frequency resonator, and more particularly, to resonator whose frequencies can be broadly and rapidly varied.

BACKGROUND OF THE INVENTION

Dielectric resonator elements are used in oscillators and filters as the frequency adjustment elements for narrow-band frequencies in the microwave and millimeter wave bands. Dielectric resonator elements are small in size, and have high Q values In addition, the resonant frequency of dielectric resonators is insensitive to temperature fluctuations. Accordingly, such resonators are being used on a rapidly-increasing scale in satellite communication devices, mobile radio devices, variable-frequency oscillators, and other applications.

While a dielectric resonator having a high Q value provides a stable resonance frequency, its resonance frequency cannot be widely varied electronically. Instead, its resonance frequency is varied mechanically, such as by mechanically varying the cavity size. However, mechanical adjustments change the resonance frequency slowly, and are bulky and expensive.

In one form of communication referred to as Minimum Shift Keying (MSK), data is sent by using two different frequencies to represent the binary data values 0 and 1, respectively. This system requires an oscillator whose frequency can be rapidly changed. The rate at which data can be transmitted in this system depends on the difference in frequency used to transmit the two data states.

Systems that allow the oscillator frequency to be shifted in response to a signal are known to the art. For example, unexamined Japanese Patent Publication No. HEI 9-205324 discloses a system in which the resonance frequency of an oscillator is altered by applying a signal to a variable capacitance element in an auxiliary transmission line. The magnetic field in the resonating element is coupled to the magnetic field of the auxiliary transmission line in this system. By altering the magnetic field, this device alters the resonant frequency. Generally, the variation in the resonance frequency is limited to about 0.1% of the resonance frequency. Hence, when a resonator of this type is used to construct a voltage-controlled oscillator that oscillates in the 5 GHz band for MSK communications, the oscillation frequency can only be varied by about 5 MHz. This limits the data transmission rate to about 10 Mbps. However, speeds exceeding 20 Mbps are sought for 5 GHz band radio communications.

Broadly, it is the object of the present invention to provide an improved dielectric resonator.

It is a further object of the present invention to provide a resonator whose resonance frequency can be shifted in response to an external electrical signal.

These and other objects of the present invention will become apparent to those skilled in the art from the following detailed description of the invention and the accompanying drawings.

SUMMARY OF THE INVENTION

The present invention is a resonator having a variable resonance frequency. The resonator includes a cavity enclosed by a conductive wall. A resonating element and a conductive plate are located within the cavity. A photoconductive element is connected between two points on the conductive plate. The photoconductive element has a first impedance when illuminated with light and a second impedance when not so illuminated, the second impedance being greater than the first impedance. The resonator also includes a light source for irradiating the photoconductive element. In the preferred embodiment of the present invention, the conductive plate is circular and includes a gap, the photoconductive element connecting two points on the gap. The preferred resonating element is a cylindrical dielectric resonator element having a $TE_{01\delta}$ mode electromagnetic field distribution, the cylindrical dielectric resonator having a cylindrical shape characterized by top and bottom surfaces and a diameter. The circular conductive plate is preferably placed parallel to the top surface of the cylindrical dielectric resonator substantially midway between the top surface and the inner surface of the top of the conducting wall. The diameter of the circular plate is preferably greater than that of the cylindrical dielectric resonator. In one embodiment of the present invention, the photoconductive element includes first and second photoconductive regions, the first photoconductive region connecting first and second points on the conductive plate and the second photoconductive region connecting third and fourth points on the conductive plate. In this embodiment, the light source includes first and second light emitting elements, for respectively illuminating said first and second photoconductive regions. The magnitude of the change in resonance frequency induced by illuminating the photoconductive region is altered by adjusting the relative position of the photoconductive element and the light source.

DETAILED DESCRIPTION OF THE INVENTION

Figure 2:
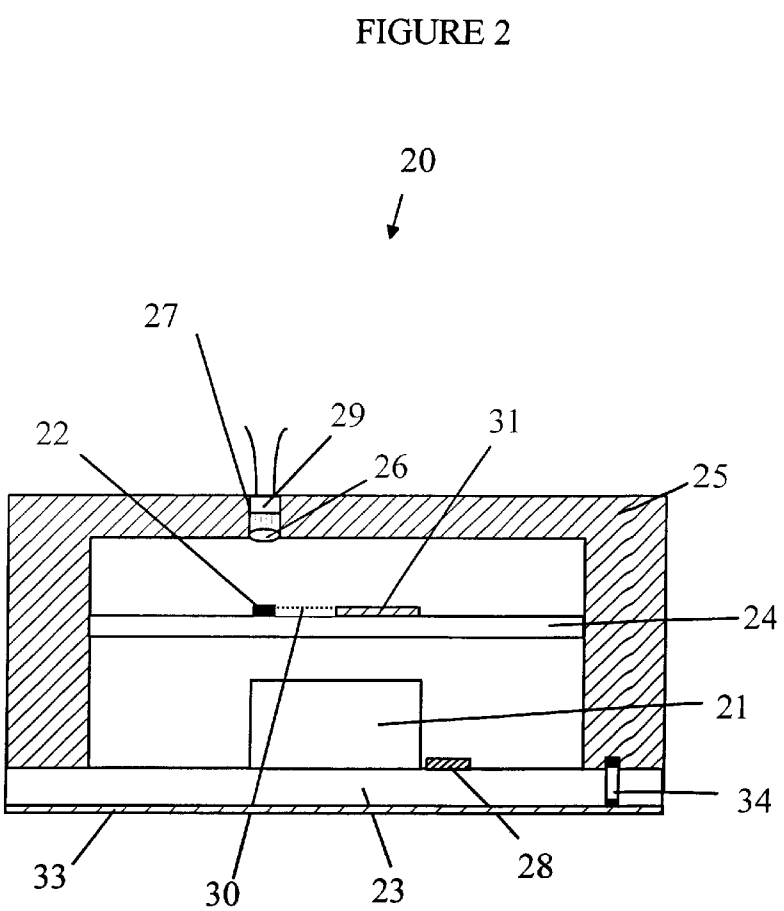
FIG. 2 is a longitudinal sectional view of the resonator 20 through line AA' shown in FIG. 1.
Figure 1:
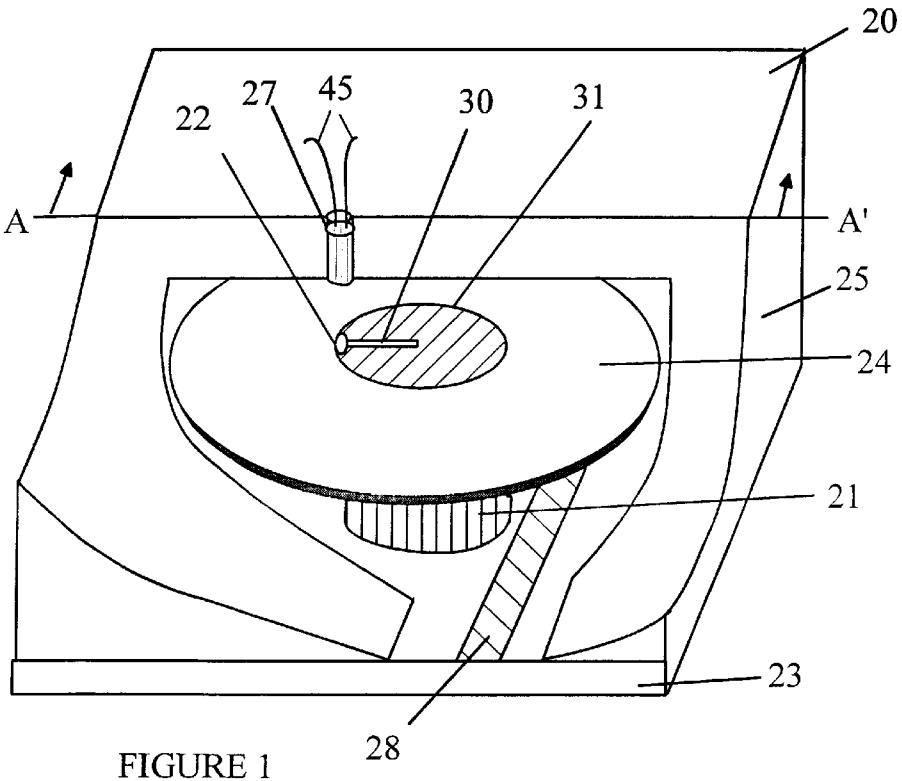
FIG. 1 is a cut-away perspective view of a resonator 20 according to one embodiment of the present invention.

The manner in which the present invention provides its advantages may be more easily understood with reference to FIGS. 1 and 2. FIG. 1 is a cut-away perspective view of a resonator 20 according to one embodiment of the present invention. FIG. 2 is a longitudinal sectional view of the resonator 20 through line AA' in FIG. 1.

Resonator 20 includes a cylindrical conducting cavity defined by a conductive wall 25 which has an opening in its bottom, and a printed circuit board 23, which seals the opening and forms the bottom surface of the cylindrical cavity. The axis of the cavity is perpendicular to the surface of printed circuit board 23. Conductive wall 25 may be copper, aluminum, or brass. Microstrip line 28 on printed circuit board 23 is used for input and output of high-frequency signals to the cavity. Conductive wall 25 confines the electromagnetic field, thus preventing leaks of the electromagnetic field, which, in turn, increases the Q of the resonator. Conductive wall 25 also supports the entire structure. The inner surface of the conductive wall 25 is smooth. Any irregularities in the finish are preferably small compared to the wavelength of the electromagnetic energy at the resonance frequency. The inner surface of conductive wall 25 may be electro-plated to improve the smoothness of the finish.

Printed circuit board 23 is a conventional printed circuit board. Printed circuit board 23 has conductors on both sides of an insulating base of ceramic or polytetrafluoroethylene. A ground plane 33 is formed on the bottom surface of printed circuit board 23. Ground plane 33 of printed circuit board 23 is electrically connected to conductive wall 25 by metallic screw 34 or by a conductive bonding agent.

The interior dimensions of the cavity formed by conductive wall 25 and printed circuit board 23 are related to the height and diameter of the cylindrical dielectric resonator element 21. The diameter and height of the cavity are about three times the diameter and height of the cylindrical dielectric resonator element 21, respectively.

The resonant frequency of resonator 20 is determined primarily by cylindrical dielectric resonator element 21 having a $TE_{01\delta}$ mode electromagnetic field distribution in the cavity. Cylindrical dielectric resonator element 21 has its axis approximately aligned to the axis of the cavity and is preferably fixedly bonded by an epoxy to the printed circuit board 23. Cylindrical dielectric resonator element 21 is constructed from a material having a high dielectric constant such as barium titanate, titanium oxide, or another ceramic oxide with a high dielectric constant. In one preferred embodiment, $Ba(MgTa)O_3$ is utilized. The dimensions of the cylinder are determined by the material used to construct dielectric resonator element 21 and by the resonance frequency. For a resonance frequency in the 5 GHz band, the diameter is about 10 cm, and the height is half the diameter.

The present invention utilizes a circular conductive plate 31 to fine tune the resonant frequency and to switch the resonant frequency between two closely spaced values. The conductive plate is formed on a dielectric substrate 24. Dielectric substrate 24 is placed midway between the top of the dielectric resonator element 21 and the inner surface of conductive wall 25 such that the substrate surface is parallel to the top of the dielectric resonator element 21 and parallel to the inner surface of conducting wall 25 that is above dielectric substrate 24. Dielectric substrate 24 is bonded to conductive wall 25. Dielectric substrate 24 is preferably a single-layer printed circuit board of a thin ceramic insulator whose thickness is between 100 to 300 $\mu$m.

A circular conductive plate 31 having substantially the same diameter as dielectric resonator element 21 is formed on the top surface dielectric substrate 24 by patterning the conductive layer of the substrate. The center of circular conductive plate 31 lies on the axis of the cavity. Circular conductive plate 31 has a radial slit 30 directed from the center toward the edge. The thickness of circular conductive plate 31 is 20 $\mu$m for a resonance frequency of 5 GHz, but a plate with a thickness from 15 $\mu$m to 30 $\mu$m will also function adequately. The thickness of conductive circular plate 31 is proportional to the wavelength of an electromagnetic signal at the resonant frequency. At a resonance frequency of 60 GHz, a plate having a thickness of 1 to 3 $\mu$m is utilized.

Figure 3:
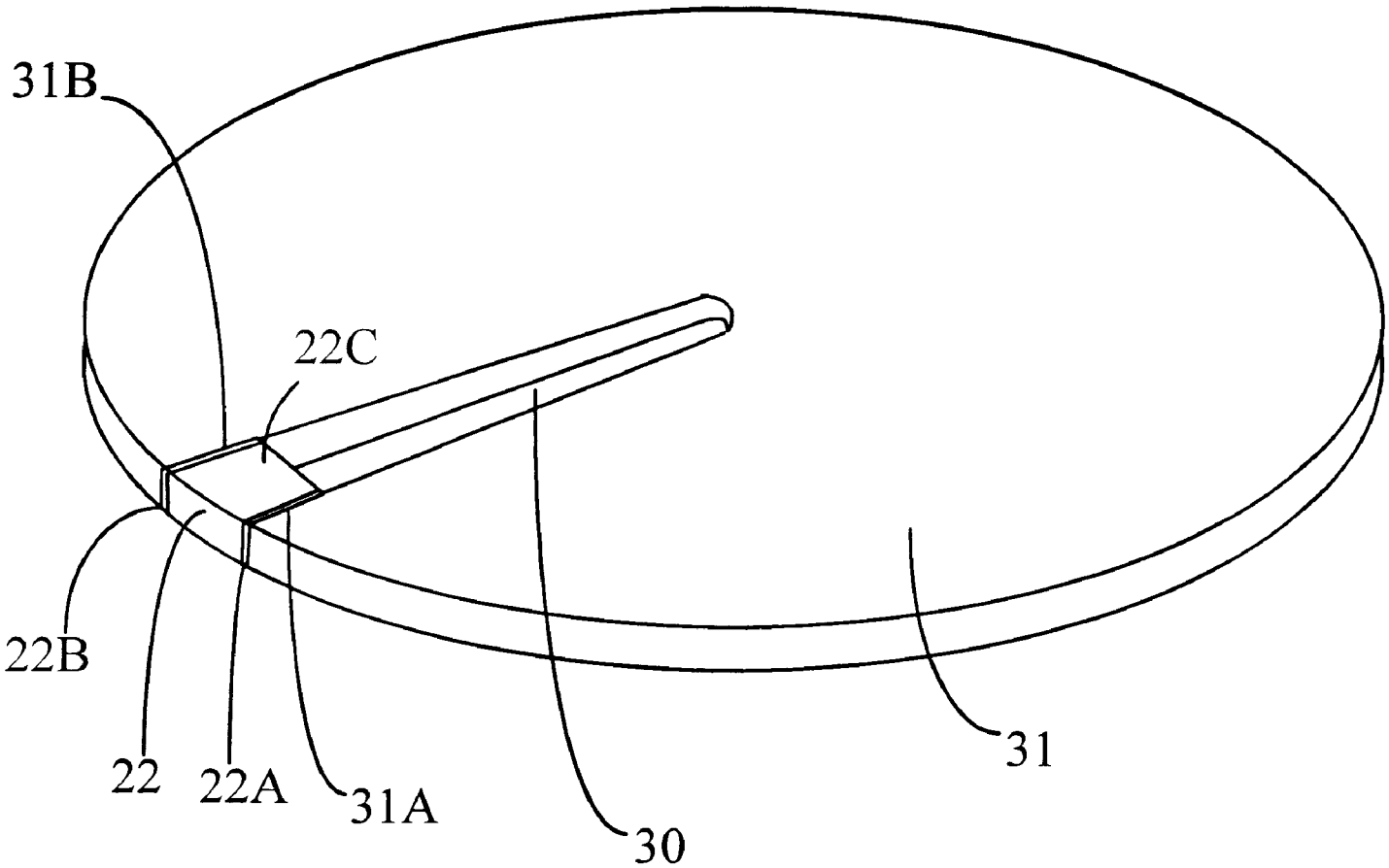
FIG. 3 is a perspective view of circular conductive plate 31 and photoconductive element 22.

A photoconductive element 22 extending across the slit is mounted on the outer edge of the circular conductive plate 31. A more detailed view of circular conductive plate 31 is provided in FIG. 3 which is a prospective view of circular conductive plate 31 and photoconductive element 22. For a resonance frequency in the 5 GHz band, the width of the slit is about 1 mm and can be expanded or reduced in proportion to the resonance wavelength.

Photoconductive element 22 is preferably a p-i-n diode. Since any electrical resistance introduced by photoconductive element 22 when it is in the conducting state will decrease the Q of the cavity, the preferred conductive element has a resistance in the conducting state of around 1 ohm or less. The terminals 22A and 22B of the p-i-n diode are electrically connected to the circular conductive plate 31 on opposite sides of slit 30. The photoconductive element 22 functions to short-circuit the slit 30 when the photoconductive element is in the conducting state.

Returning now to FIGS. 1 and 2, photoconductive element 22 is activated by a light source 27 that preferably includes a semiconductor laser 29 and a lens 26. The semiconductor laser should preferably be a surface-emitting semiconductor laser. Laser light emitted from the light source 27 is focused and adjusted by the lens 26, and is input into the photoconductive element 22. At a higher frequency such as 60 GHz, the distance between the semiconductor laser 26 and the photoconductive element 22 is reduced because the dimensions of the cavity are smaller. In such cases, the lens can be omitted. The light source 27 is energized by a signal applied to leads 45 from a transmission apparatus. To simplify the drawing, the transmission apparatus is not shown. In the preferred embodiment of the present invention, light source 27 extends through a hole in conductive wall 25.

The diameter of circular conductive plate 31 is preferably the same or slightly larger than the diameter of cylindrical dielectric resonator element 21. The slit 30 extends from approximately the center of circular conductive plate 31 to the edge of the plate. On the outside of the circular conductive plate 31, the terminals 22A and 22B of photoconductive element 22 are connected to the ends 31A and 31B of the vertical wall of the circular conductive plate 31 on both sides of the slit 30.

The position of light source 27 is adjusted such that the irradiation spot generated by light source 27 hits light receptor 22C of photoconductive element 22. The irradiation pattern must be sufficiently broad to assure that the photoconductive element shorts the edges of the slit together when irradiated. The precise radial position at which the short occurs can be adjusted by altering the position of light source 27 relative to photoconductive element 22. The position of the short determines the shift in resonance frequency of resonator 20 when light source 27 is irradiating photoconductive element 22.

The manner in which the resonance frequency of resonator 20 is modulated by the signal to light source 27 will now be explained in more detail. The resonating electrical field is confined to a cross-sectional surface inside dielectric resonator element 21, and has a concentrated doughnut-shaped distribution. When conductive plate 31 is placed parallel and close to the top of dielectric resonator element 21 on the center axis of dielectric resonator element 21, and the photoconductive element 22 is not irradiated, a concentrated portion of an electrical field also forms in the slit 30. Intermittent emission of laser light can turn the photoconductive element 22 on and off, and bring about wide variations in the distribution of the electrical field concentrated in slit 30. The variations in the electrical field distribution change the effective electrical length of the resonator element thereby causing the resonance frequency to change.

When light source 27 is off, slit 30 is substantially open at the circumferential edge of circular conductive plate 31, and the electrical field is primarily concentrated on the outside of the cylindrical conductive plate surface around the circumference. In this configuration, the electrical field at slit 30 is parallel to, and is oriented in the opposite direction from, the electrical field of dielectric resonator element 21. This is equivalent to reducing the portion of the electrical field distribution in resonator element 21, which has the same effect as reducing the size of resonator element 21, which, in turn, increases the resonance frequency.

When light source 27 is on, slit 30 can be regarded as having a short-circuit along the circumference of circular conductive plate 31. In this case, the electrical field in the center part of slit 30 is parallel to, and is oriented in the same direction as, the electrical field in the dielectric resonator element 21. This is equivalent to increasing the portion of the electrical field distribution in the resonator element 21, which has the same effect as increasing the size of resonator element 21, which, in turn, decreases the resonance frequency.

It should be noted that the coupling between the electric field in slit 30 and resonating element 21 is much higher than the magnetic coupling between an auxiliary transmission line and a resonating element used in the prior art device discussed above. Accordingly, the present invention can provide a much greater variation in the resonance frequency than such prior art devices.

The present invention requires two calibrations, one to set the resonant frequency when light source 27 is turned off and one to set the shift in resonant frequency induced when light source 27 is turned on. The first calibration is performed by varying the position of printed circuit board 23 relative to conductive wall 25 while the resonance state is monitored from the microstrip line 28. When the desired resonance frequency is obtained, the frequency variation is optimized by turning on the light source and varying the irradiation position while monitoring the altered resonance frequency. Once the correct position is determined, light source 27 is fixed in position by a suitable bonding agent or mechanical mechanism such as a setscrew.

Figure 4:
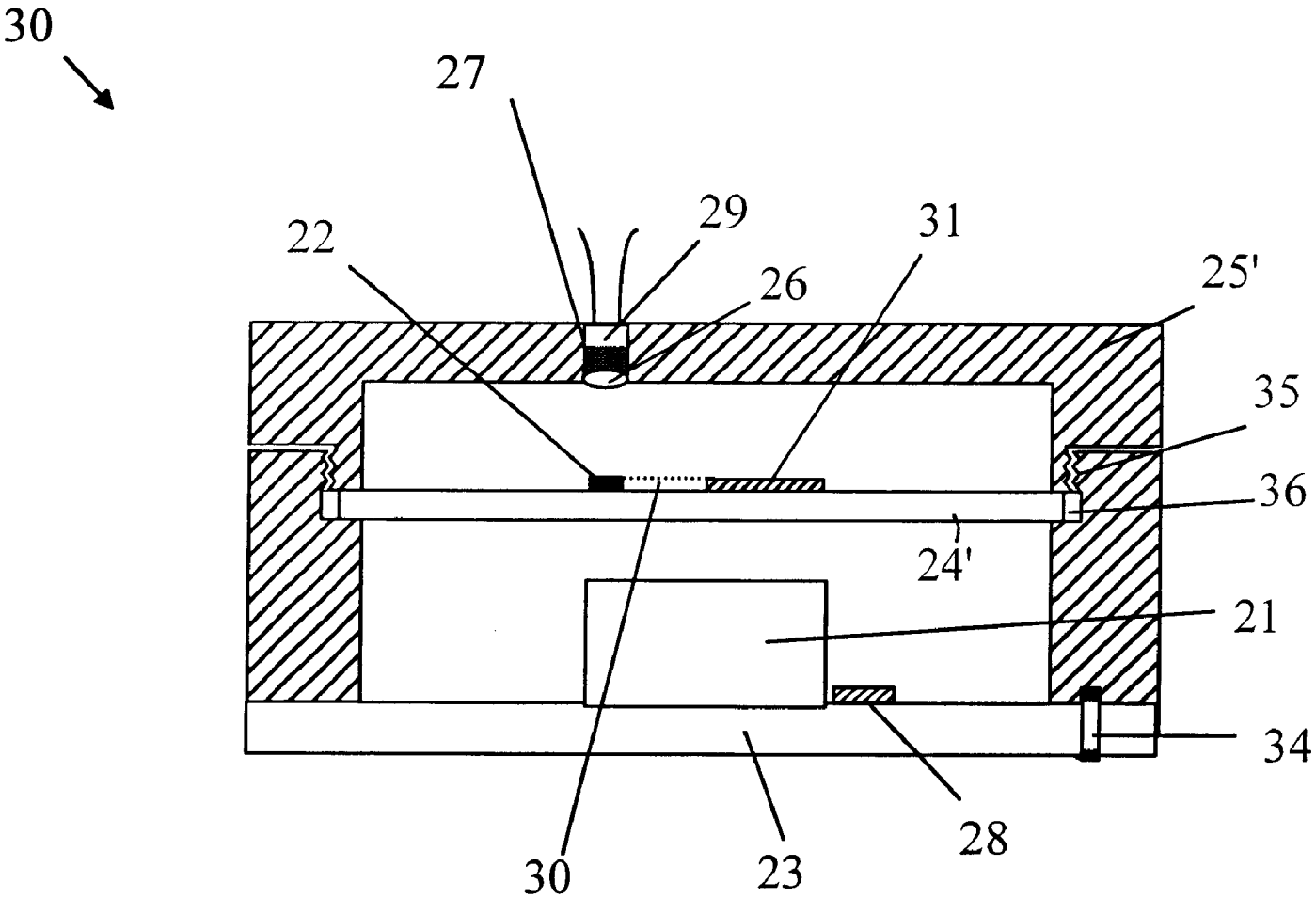
FIG. 4 is a cross-sectional view of a second embodiment of the present invention.

The adjustment of printed circuit board 24 can be facilitated by separating conductive wall 25 into two parts as shown in FIG. 4. FIG. 4 is a cross-sectional view of a second embodiment of the present invention. To simplify the following discussion, elements that perform the same function in FIG. 4 as elements shown in FIGS. 1–3 have been given the same numeric designations. Resonator 30 shown in FIG. 4 differs from resonator 20 shown in FIGS. 1–3 in that the conductive wall of resonator 20 has been replaced by a two piece wall 25'. The two parts are screwed together with the aid of the mating threaded regions shown at 35 at the position where the dielectric substrate 24' is to be located. Dielectric substrate 24' is held between the two parts. In addition, dielectric substrate 24' differs from dielectric substrate 24 shown in FIGS. 1–3 in that a portion of the dielectric substrate 24' projects into conducting wall 25'. In addition, the slot in wall 25' that engages dielectric substrate 24' includes enough space 36 to allow dielectric substrate 24' to move relative to dielectric resonator 21. Hence, during calibration, dielectric substrate 24' can be more easily positioned with respect to conductive wall 25'.

The above-described embodiments of the present invention utilize a single photoconductive element and light source. This arrangement provides a means for modulating the resonance frequency between two values. However, embodiments of the present invention in which the resonance frequency is modulated between more than two values can also be constructed. In such embodiments, a plurality of photoconductive elements are installed along the slit, and the resonance frequency is modulated with multiple values by switching the appropriate photoconductive elements on and off with the aid of a plurality of corresponding light sources. It should be noted that the plurality of photoconductive elements described above can be replaced by a single continuous photoconductive element covering the appropriate portion of the slit.

The above-described embodiments of the present invention utilize a p-i-n diode as the photoconductive element. However, it will be obvious to those skilled in the art from the preceding discussion that any photoconductive element that can be switched between a conducting and insulating state can be utilized.

Various modifications to the present invention will become apparent to those skilled in the art from the foregoing description and accompanying drawings. Accordingly, the present invention is to be limited solely by the scope of the following claims.

What is claimed is:

1. A resonator having a variable resonance frequency, said resonator comprising:

a cavity enclosed by a conducting wall;

a resonating element;

a conductive plate located in said cavity;

a photoconductive element connected between two points on the conductive plate, said photoconductive element having a first impedance when illuminated with light and a second impedance when not so illuminated, said second impedance being greater than said first impedance; and a light source for irradiating said photoconductive element with said light.

2. The resonator of claim 1 wherein said conductive plate comprises a gap, said photoconductive element connecting two points on said gap.

3. The resonator of claim 1 wherein said light source comprises a plurality of light emitting elements, each light emitting element illuminating a different location of said conductive plate.

4. The resonator of claim 1 wherein said resonating element comprises a cylindrical dielectric resonator element having a $TE_{01\delta}$ mode electromagnetic field distribution, said cylindrical dielectric resonator having a cylindrical shape characterized by top and bottom surfaces and a diameter.

5. The resonator of claim 1 wherein said conductive plate is disposed parallel to the top surface of said resonator element substantially midway between said top surface and an inner surface of said conducting wall.

6. The resonator of claim 5 wherein said conductive plate is a circular metal plate having a diameter larger than said diameter of said resonator element.

7. A resonator having a variable resonance frequency, said resonator comprising:

a cavity enclosed by a conducting wall;

a resonating element;

a conductive plate located in said cavity;

a photoconductive element connected between two points on the conductive plate, said photoconductive element having a first impedance when illuminated with light and a second impedance when not so illuminated, said second impedance being greater than said first impedance; and a light source for irradiating said photoconductive element with said light, wherein said photoconductive element comprises first and second photoconductive regions, said first photoconductive region connecting first and second points on said conductive plate and said second photoconductive region connecting third and fourth points on said conductive plate.

8. A resonator having a variable resonance frequency, said resonator comprising:

a cavity enclosed by a conducting wall;

a resonating element;

a conductive plate located in said cavity;

a photoconductive element connected between two points on the conductive plate, said photoconductive element having a first impedance when illuminated with light and a second impedance when not so illuminated, said second impedance being greater than said first impedance; and a light source for irradiating said photoconductive element with said light, wherein the relative position of said photoconductive element and said light source is adjustable.

9. A resonator having a variable resonance frequency, said resonator comprising:

a cavity enclosed by a conducting wall;

a resonating element;

a conductive plate located in said cavity;

a photoconductive element connected between two points on the conductive plate, said photoconductive element having a first impedance when illuminated with light and a second impedance when not so illuminated, said second impedance being greater than said first impedance; and a light source for irradiating said photoconductive element with said light, wherein said conducting wall comprises first and second separable sections that can be secured to one another, wherein said first and second separable sections define a region for engaging a dielectric sheet on which said conductive plate is mounted, wherein said region is sufficiently large to allow said dielectric sheet to move relative to said resonating element when said separable sections are not secured to one another, and wherein said dielectric sheet is fixed relative to said resonating element when said sections are secured to one another.

* * * * *